US012582866B2

(12) United States Patent
Apuzzo

(10) Patent No.: US 12,582,866 B2
(45) Date of Patent: Mar. 24, 2026

(54) EXERCISE BENCH WITH SIDE PADS

(71) Applicant: Mark Anthony Apuzzo, Grand Forks, ND (US)

(72) Inventor: Mark Anthony Apuzzo, Grand Forks, ND (US)

( * ) Notice: Subject to any disclaimer, the term of this patent is extended or adjusted under 35 U.S.C. 154(b) by 140 days.

(21) Appl. No.: 18/380,655

(22) Filed: Oct. 17, 2023

(65) Prior Publication Data

US 2025/0121247 A1 Apr. 17, 2025

(51) Int. Cl.
*A63B 21/00* (2006.01)

(52) U.S. Cl.
CPC ..... *A63B 21/4029* (2015.10); *A63B 21/4035* (2015.10); *A63B 2225/093* (2013.01)

(58) Field of Classification Search
CPC ..... A63B 21/4029; A63B 21/4031; A47C 7/546
See application file for complete search history.

(56) References Cited

U.S. PATENT DOCUMENTS 4,971,040 A * 11/1990 Gillotti ..... A61G 15/007 601/48
5,180,354 A * 1/1993 Jones ..... A63B 23/00 482/133
6,605,023 B1 * 8/2003 Mobley ..... A63B 21/4029 482/142
9,033,854 B1 * 5/2015 Butkovic ..... A63B 23/1281 482/104
9,669,278 B1 6/2017 Brown
10,675,499 B2 6/2020 Vorozilchak et al.
10,850,154 B2 12/2020 Baker et al.
2007/0126271 A1 * 6/2007 Brodeur ..... A47C 7/024 297/311
2011/0065554 A1 * 3/2011 Van Straaten ..... A63B 21/4029 482/130
2015/0224359 A1 * 8/2015 Kalleen ..... A63B 21/4029 482/104
2021/0387041 A1 12/2021 Rodriguez et al.
2023/0048783 A1 * 2/2023 Miller ..... A63B 21/078

FOREIGN PATENT DOCUMENTS

WO WO-9832354 A1 * 7/1998 ..... A47C 7/54

OTHER PUBLICATIONS

Prime Fitness USA, "Adjustable Bench", Sep. 28, 2024 (Year: 2024).*

* cited by examiner

*Primary Examiner* — Joshua T Kennedy

(57) ABSTRACT

An exercise bench apparatus includes a main frame with a height-adjustable back rest and a pair of adjustably connected side pads. The side pads incorporate a unique mechanism involving a solid bar, splined shaft, L-shaped connector, mounting plate, pad rotation plate with holes at set intervals, and a spring-loaded pin system allowing precise upward, downward, and sideways adjustments. Additionally, the apparatus features a resting head pad aligned with the back rest and a pivotally attached sitting pad that adjusts for diverse exercise postures, providing comprehensive support for an enhanced workout experience. A handle on the main frame facilitates bench repositioning. The bench's stability is ensured by a footing mechanism, designed with non-slip materials and multiple feet for even weight distribution and surface protection. This innovative apparatus promises versatile and comfortable exercise configurations.

11 Claims, 16 Drawing Sheets

EXERCISE BENCH WITH SIDE PADS

TECHNICAL FIELD

The present invention pertains to the domain of exercise equipment, especially focusing on the design and functionalities of exercise benches. Specifically, this invention introduces an innovative exercise bench equipped with adjustable side pads, ensuring that users not only benefit from a broad spectrum of workout variations but also enjoy the added comforts of stability, adaptability, and convenient storage.

BACKGROUND OF THE INVENTION

Exercise benches, over the decades, have become a cornerstone of both professional gymnasiums and personal home workout spaces. Their primary purpose is to offer a robust and stable platform upon which users can execute a wide array of exercises ranging from weightlifting to bodyweight regimes. Historically, these benches were simplistic in design, catering to a select few exercises, which unfortunately limited the scope of workouts a user could undertake.

Traditional exercise benches, while effective for a subset of exercises, are often found lacking when it comes to addressing the evolving fitness demands of contemporary users. For instance, the fixed structure of many traditional benches restricts users from tapping into a more diverse workout regimen. This limitation emerges from the bench's inherent lack of adaptability and customization features.

U.S. Pat. No. 10,675,499B2 discloses an adjustable weight lifting bench that includes a frame, a seat pad, and a back pad. The back pad is pivotably coupled to the frame about a first pivot axis and angularly adjustable between a plurality of user-selectable incline and decline positions. A hydraulic mechanism supports the back pad in the incline and decline positions. A movable operating lever operably coupled to the hydraulic mechanism operates to change the mechanism between an activated condition in which the back pad is movable and a deactivated condition in which the back pad locks into a selected one of the positions. When the mechanism is in activated condition, applying pressure against the back pad the lowers the back pad and removing the pressure raises the back pad. In one embodiment, the mechanism automatically raises the back pad when the pressure is removed and the mechanism is in the deactivated condition.

US20210387041A1 discloses exercise benches comprising a rigid structure having an interior cavity, with portions of the structure covered in a durable exercise friendly fabric and an underlayment of foam for padding. The benches have a generally horizontal base for resting on the floor or ground using anti-skid pads. The base is rectangular with the longer sides each connecting to opposed sides having inclined surfaces providing structural support for a generally horizontal top surface. In one embodiment the top surface may be pivotably connected to enable lifting of the top surface engageable with an adjustable support member located in the cavity to hold the top surface in place in an inclined position. In multiple embodiments fasteners, such as a D-rings are positioned on the sides of the bench for attaching to exercise resistance bands. In one embodiment vertical end walls have an opening with a fabric liner formed inwardly forming an interior fabric for storage. A D-Ring fastener may be attached to the end walls to connect to exercise resistance bands. The benches may have interior structures to support speakers incorporated into the benches.

U.S. Pat. No. 9,669,278B1 discloses an adjustable declined exercise bench and adjustable punching or striking attachments for the exercise bench that attach to the upper end of the bench. The bench is segmented into an upper stationary end segment and a lower pivotable end segment. The lower end segment of the bench where the user's back or will rest can swivel with the movement of the user's torso. Movement of the lower segment of the bench is in opposition to a resistance band that keeps the lower segment under tension and tends to hold the lower segment in an aligned position relative to the upper segment of the bench.

U.S. Pat. No. 10,850,154B2 discloses a storable exercise bench. The exercise bench may include a frame including at least one beam operatively coupled to first and second floor supports and a member operatively coupled with the at least one beam. The exercise bench may be positioned into an operating position in which the first and second floor supports support the at least one beam and the member, and the at least one beam runs generally horizontally in reference to a support surface. The exercise bench may be positioned into a storage position in which the second floor support and the member support the at least one beam and the first floor support, and the at least one beam runs generally vertically in reference to the support surface.

As we delve deeper into the 21st century, a noticeable trend within the fitness community is the growing thirst for knowledge. Today's fitness enthusiasts are not just content with following prescribed routines; they are keen on understanding the mechanics behind each exercise and tailoring their workouts to fit their unique physiological needs. This surge in fitness consciousness has given rise to a demand for more versatile workout equipment. Benches, being central to many exercises, are no exception to this trend. While the market has seen the introduction of benches with adjustable backrests, a glaring gap persists when we consider the absence of adjustable side pads. Such pads can significantly elevate the workout experience by providing pivotal arm support, facilitating a range of exercises that were previously unattainable on traditional benches.

Another often overlooked aspect of exercise benches, especially in the context of home gyms, is the issue of storage and mobility. Many urban dwellers, although passionate about fitness, are restricted by limited living spaces. Traditional exercise benches, not designed with space economy in mind, often end up being a cumbersome piece of equipment that's difficult to store and move.

Given these challenges and the clear demand for a more evolved exercise bench, it's evident that there's a pressing need for a solution. This solution should not only enhance the versatility of workouts but should also provide additional functionalities like adjustable side pads. Furthermore, practical concerns such as easy storage and mobility should also be addressed.

The objective of the present invention, thus, is to bridge these existing gaps in the realm of exercise benches. Through its novel design and features, it aims to cater to both the nuanced needs of modern fitness enthusiasts and the practical challenges they face in their workout environments.

SUMMARY OF THE INVENTION

In light of the disadvantages mentioned in the previous section, the following summary is provided to facilitate an understanding of some of the innovative features unique to the present invention and is not intended to be a full description. A full appreciation of the various aspects of the invention can be gained by taking the entire specification and drawings as a whole.

The present invention introduces a revolutionary exercise bench that seamlessly combines stability, versatility, and user-centric design. Unlike traditional benches that offer limited functionality, this bench is anchored by a robust fixed frame that lays the foundation for its advanced features. One of its standout attributes is the adjustable side pads, ingeniously crafted to move in a two-dimensional plane-both up-and-down and in a rotational manner. This dual-movement capability allows users to position the pads at myriad angles, ensuring optimal support for a vast array of exercises. The side pads' adaptability is further enhanced by a specialized mechanism involving a splined male pinion, a splined female housing, and a series of plates with a spring-loaded pin.

Additionally, the main back frame, pivotal in nature, extends from the fixed frame and offers dynamic movement between a flat storage position and several deployed exercise positions. Complementing the back frame is an adjustable sitting pad, equipped with a spring-loaded pin, providing users the flexibility to set different seating angles. Stability, an essential facet of the design, is addressed with a three-foot system that not only grounds the bench but also incorporates rubber pads to safeguard floor surfaces. Enhancing its appeal further, the bench is designed with mobility in mind; a strategically positioned handle enables users to relocate the bench effortlessly within their workout space. In sum, this exercise bench transcends conventional design, offering users a uniquely integrated workout experience, replete with innovative features that prioritize both exercise diversity and convenience.

This summary is provided merely for purposes of summarizing some example embodiments, to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description and figures.

The abovementioned embodiments and further variations of the proposed invention are discussed further in the detailed description.

DETAILED DESCRIPTION

Figure 1:
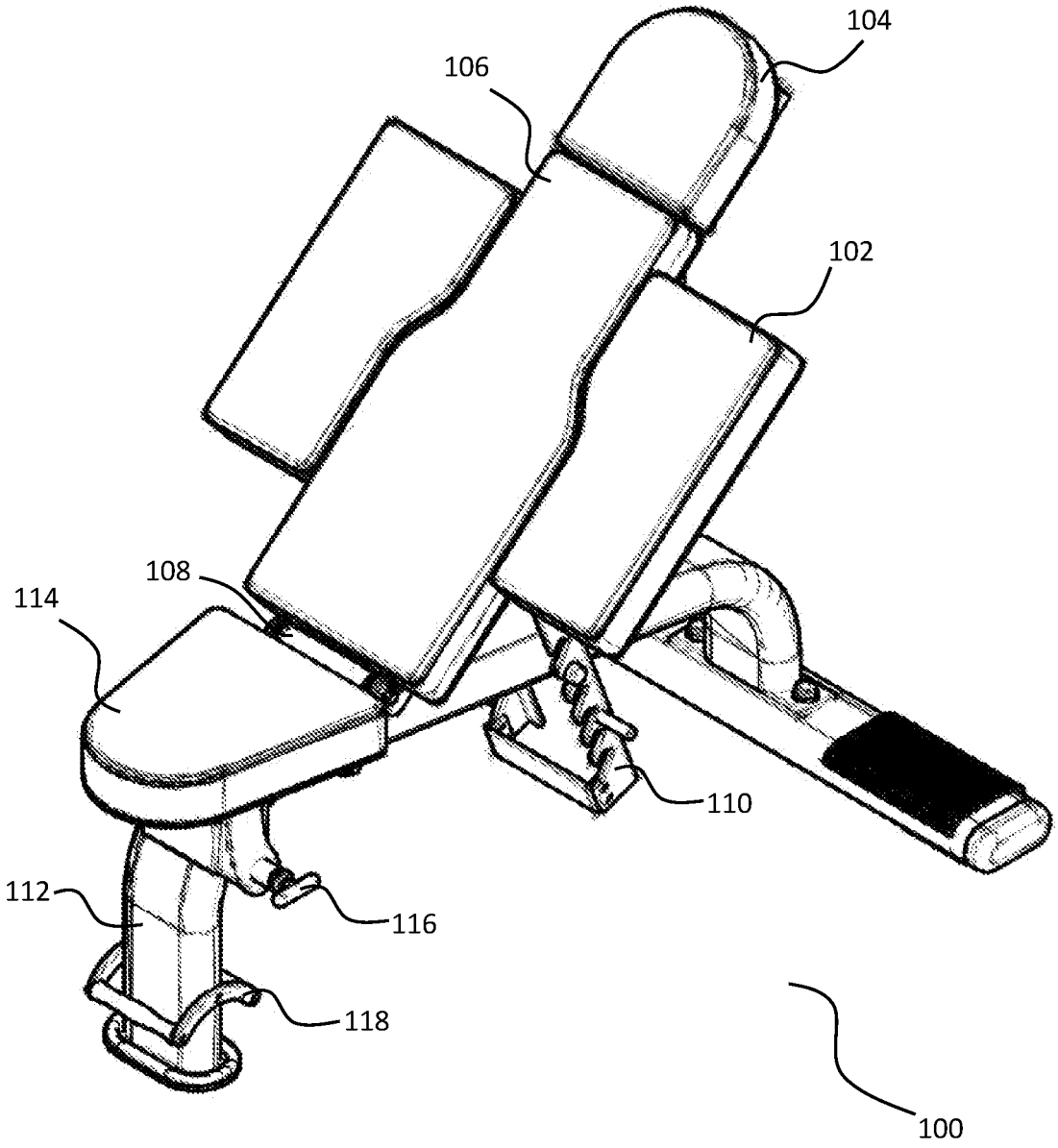
FIG. 1 is a perspective view of the exercise bench with pads 100 according to the embodiments of the present disclosure.

In the following description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limited sense, and the scope of the present invention is defined only by the appended claims.

The specification may refer to "an", "one" or "some" embodiment(s) in several locations. This does not necessarily imply that each such reference is to the same embodiment(s), or that the feature only applies to a single embodiment. Single feature of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exercise benches have long been a cornerstone in fitness and rehabilitation facilities, serving as tools for myriad strength-training exercises. As exercise methods have evolved and diversified over the years, so too have the designs of these benches, aiming to accommodate a broad spectrum of user needs and preferences. However, despite these evolutions, the conventional designs of many exercise benches continue to exhibit discernible shortcomings.

A predominant limitation observed in many traditional exercise benches is their lack of versatility. These benches usually offer a restricted adjustability that's largely confined to the backrest. Such a constrained range of motion makes it challenging for users to modify the bench to align with specific exercises or accommodate unique physical conditions. Furthermore, the absence of adequate arm support in most benches has been a glaring oversight. Engaging in exercises without proper arm support not only compromises the quality of the workout but also exposes users to heightened risks of strains and injuries.

Another practical challenge posed by many conventional benches is their mobility or, more precisely, the lack thereof. These pieces of equipment, often characterized by their heft and bulk, can be cumbersome to relocate within a gym or exercise area. While certain designs have sought to address this by integrating wheels, such additions frequently prove inadequate in delivering the desired manoeuvrability. The issue of storage further compounds the drawbacks of many traditional benches. Without the capability to fold or compact efficiently, these benches can be particularly inconveniencing, especially in home gyms or facilities that grapple with space constraints.

Lastly, the durability of many exercise benches leaves much to be desired. Constant and rigorous use subjects these benches to considerable wear and tear, yet a significant number of conventional designs don't adequately factor in this inevitable degradation, resulting in a compromised lifespan of the product.

In response to these challenges, the present invention emerges as a beacon of innovation, presenting an advanced exercise bench replete with side pads and a suite of user-centric features. Central to its design is an emphasis on versatility. The bench, characterized by a unique pivot mount, allows the main back frame to adjust in both upward and downward trajectories. Such flexibility empowers users to tailor the bench in line with their individual workout preferences and comfort considerations.

Complementing its adjustability is the inclusion of side pads, situated on both the left and right flanks of the bench. These pads provide the much-needed arm support that's conspicuously missing in many traditional designs, ensuring that users can execute their workouts in comfort and with minimal risk of undue strain or injury.

Addressing the mobility challenges of conventional designs, this inventive exercise bench integrates a handle, simplifying the process of relocating the equipment within an exercise setting. Storage, another longstanding challenge, is adeptly tackled by the bench's design which allows the back and side pads to assume a horizontal position, ensuring the bench remains compact when not in active use.

Beyond these functional enhancements, the bench's robust design merits special mention. The main frame, enveloped in a protective rubber casing, offers dual benefits: it acts as a shield against dust and potential external damages, and it mitigates risks of injuries from inadvertent contact with sharp edges. Pivotal adjustments further elevate the bench's adaptability quotient. Both the sitting pad and the main back frame are endowed with pivot systems, allowing for nuanced modifications. The sitting pad boasts four distinct positional adjustments, and the main pad can be fine-tuned at angles in ten-degree increments.

Lastly, the side pads, mounted on solid bars beneath the main frame, introduce a novel mechanism for adjustability. Equipped with splined male bushings, these bars enable the side pads to be adjusted at varied angles, accommodating both upward and downward movements.

Collectively, these innovations not only address the limitations of previous designs but also position the present invention as an ergonomic, user-friendly, and durable solution, catering to both fitness novices and seasoned professionals.

The innovative exercise bench, as conceived in this invention, stands as a testament to thoughtful engineering combined with a deep understanding of user needs in the realm of fitness. Each component is meticulously designed, not only to function seamlessly with its counterparts but also to elevate the overall experience of the user. As we delve into the anatomy of this exercise bench, it becomes evident that every part, whether predominant or subtle, plays a pivotal role in the bench's functionality.

Main Frame: The backbone of the entire structure, the main frame is meticulously engineered to provide both stability and flexibility. Created using high-quality materials, it ensures robustness, allowing the bench to cater to a wide demographic of users regardless of their weight. This durability is further amplified by a protective rubber cover that encases the frame, serving dual purposes. Firstly, it shields the frame from potential damages like scratches, dents, or impact-related wear. Secondly, it acts as a safety measure, ensuring that users do not come into contact with sharp edges or corners, thereby minimizing the risk of injuries.

Back Frame and Sitting Pad: The back frame and the sitting pad, pivotal for user comfort, demonstrate thoughtful ergonomics. The back frame's adjustability, courtesy of its pivot mount system, offers users the freedom to alter its position both upwards and downwards. This movement is facilitated smoothly, preventing any jarring transitions that might disrupt the user's workout flow. The sitting pad, meanwhile, boasts four distinct adjustment positions. This feature ensures that users of varying heights and body types can find a position that aligns perfectly with their posture, minimizing strain and maximizing workout efficacy.

Side Pads: A standout feature of the exercise bench, the side pads, is an innovation born out of acute awareness of user needs. Positioned on either side of the bench, these pads are firmly anchored via solid bars beneath the main frame. Beyond just offering arm support during exercises, these pads are a testament to adaptive design. The integration of splined male bushings allows users to adjust the side pads, ensuring they can be repositioned to accommodate different exercises or user preferences. This design element, while enhancing comfort, also expands the range of exercises the bench can support.

Pivot Systems: The pivot systems, central to both the sitting pad and the main back frame, are emblematic of the bench's adaptability ethos. These systems allow for intricate adjustments, ensuring that the bench aligns seamlessly with the user's workout regime. The main back frame's pivot, in particular, stands out, allowing users to fine-tune its position at specific angles. Such precision ensures that the bench can adapt to diverse exercise requirements, from strength training to flexibility exercises.

Handle and Mobility Mechanism: Understanding the dynamics of a modern fitness environment, where space can be at a premium and equipment might need to be relocated frequently, the exercise bench is fitted with a mobility mechanism. At the forefront of this design decision is the handle, ergonomically positioned and crafted to ensure a firm grip. This handle, combined with the bench's design when in a non-deployed state, makes relocation and storage a hassle-free task. Whether it's moving the bench to a different spot within a gym or storing it post-workout, the handle ensures that these tasks can be accomplished with minimal effort.

Footing Mechanism: A feature that might seem understated but plays a crucial role in the bench's stability is its three-foot system. This tri-foot arrangement, coupled with rubber pads, ensures that the bench remains firmly grounded, eliminating any wobbles or shakes during exercises. The rubber pads serve a dual purpose: they grip the floor firmly, ensuring the bench doesn't shift unexpectedly, and they also act as a protective layer, preventing potential floor damage or scratches.

Each component of the exercise bench, from its robust main frame to its adaptable side pads, has been designed with user experience at its core. Whether it's the safety features like the rubber encasing or the adaptability showcased by the pivot systems, every element of the bench elevates its overall functionality. This exercise bench, with its harmonious amalgamation of components, promises an unparalleled workout experience, redefining standards in fitness equipment design.

Referring to the figures, FIG. 1 is a perspective view of the exercise bench with pads 100 according to the embodiments of the present disclosure. Side pad 102 refers to a cushioned or padded area designed for user comfort and support. In the context of an exercise bench, it's typically where a user might rest parts of their body, like arms or shoulders. Side pads can offer support during certain exercises and can be adjustable for comfort and positioning. Resting head pad 104 is a padded area where a user can rest their head while performing exercises on the bench. It's particularly useful for exercises where the user lies down, ensuring comfort and reducing strain on the neck. Back rest 106 refers to the main part of the bench where the user's back rests when they lie down. It's essential for exercises like bench presses, and depending on the design, it might be adjustable to different angles for varied exercises. Pivot mount 108 is a mechanism that allows parts of the exercise bench, like the back seat or sitting pad, to rotate or pivot. It provides adjustability, enabling the user to change the bench's angle or position to suit different exercises. Sawtooth frame 110 is a locking mechanism designed with a series of notches (resembling the teeth of a saw). It's used in adjustable benches to lock different components, like the back seat, into a specific angle or position. A corresponding latch or pin engages with these notches to securely lock the position. Main frame 112 is the primary structural component of the exercise bench, providing stability and support. All other components, like the back seat, side pad, and sitting pad, are attached to this main frame. It's usually constructed from durable materials to withstand the weight and usage. Sitting pad 114 is the part of the bench where the user sits. In the context of an adjustable bench, the sitting pad might be pivotally attached so it can adjust to different angles or positions. Locking assembly 116 refers to a set of components that work together to lock parts of the bench, like the back seat or sitting pad, into a specific position or angle. This ensures user safety by preventing unintended movement during exercises. Handle 118 is a component that allows the user to easily move or reposition the entire bench. It's typically located on the main frame and designed for a comfortable grip, making it easier to transport or adjust the bench's location within an exercise area.

Figure 2:
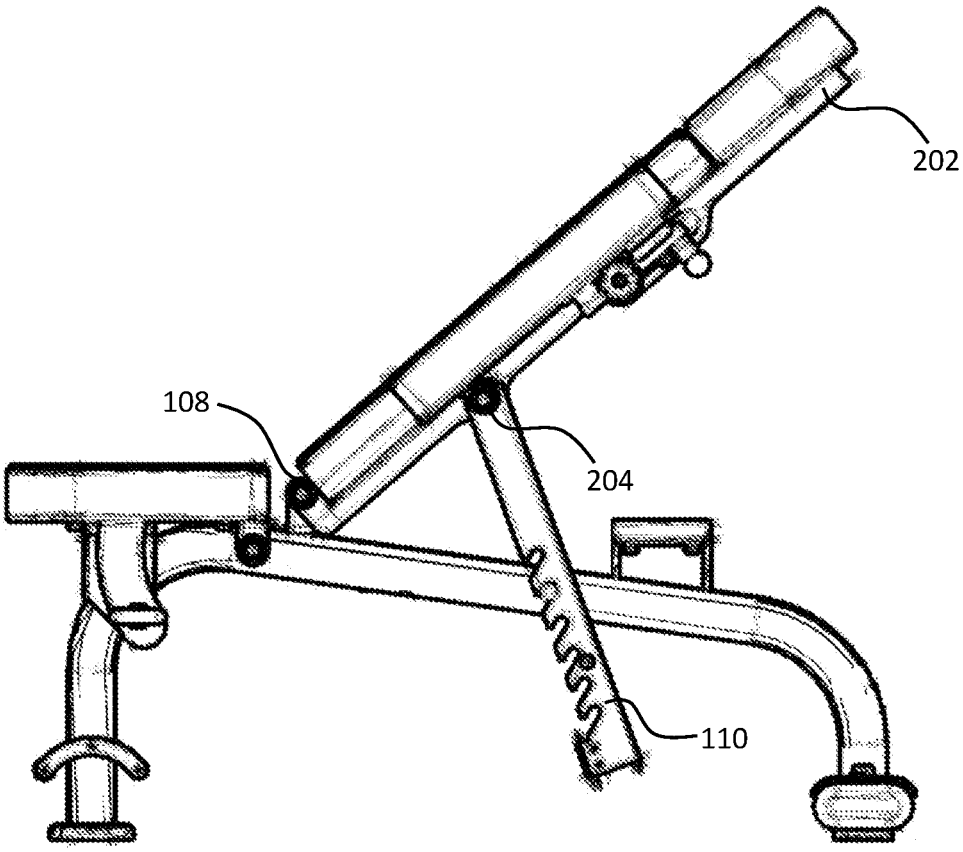
FIG. 2 is a side view of the exercise bench with pads 100 with the bench in a midway upward position according to the embodiments of the present disclosure.

FIG. 2 is a side view of the exercise bench with pads 100 with the bench in a midway upward position according to the embodiments of the present disclosure. The main back plate 202 serves as the foundational structural component of the exercise bench's back seat or resting area. It provides rigidity and support for the back seat, ensuring it can support the user's weight during exercises. Typically made of a sturdy material like metal or reinforced plastic, this plate might be directly underneath the cushioned back seat and acts as its backbone, to which other adjustable or movable components might be attached. The end pivot mount 204 is a mechanism that facilitates rotation or pivoting of a component of the exercise bench. This pivot mount allows parts of the bench, such as the back seat or the main back plate, to rotate or change angles for adjustability. This feature would enable users to set the bench to various incline or decline positions, making it versatile for different exercises.

Figure 3:
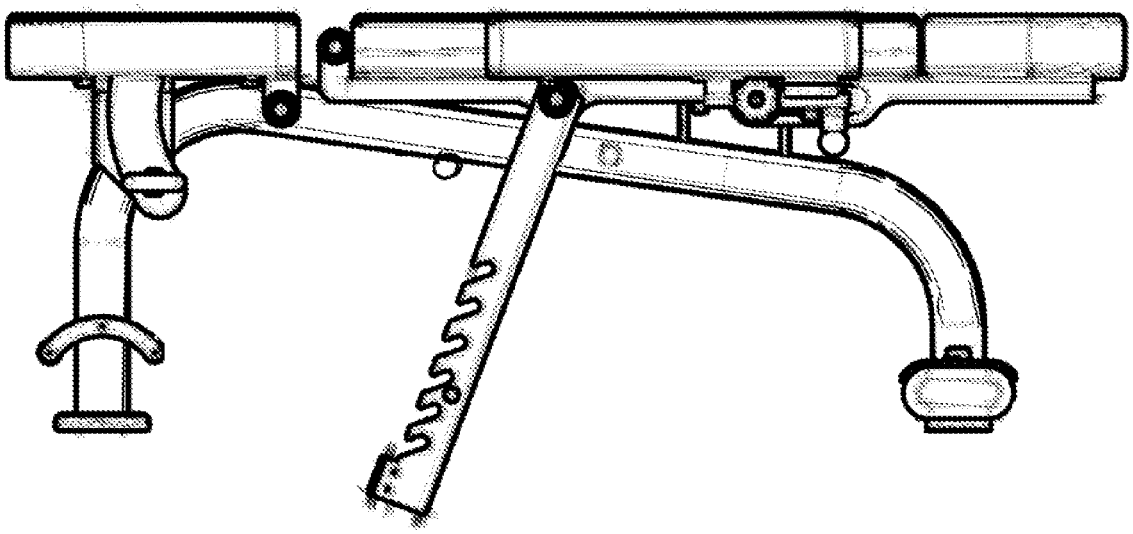
FIG. 3 is a side view of the exercise bench with pads 100 with the back rest in the horizontal position according to the embodiments of the present disclosure.

FIG. 3 is a side view of the exercise bench with pads 100 with the back rest in the horizontal position according to the embodiments of the present disclosure.

Figure 4:
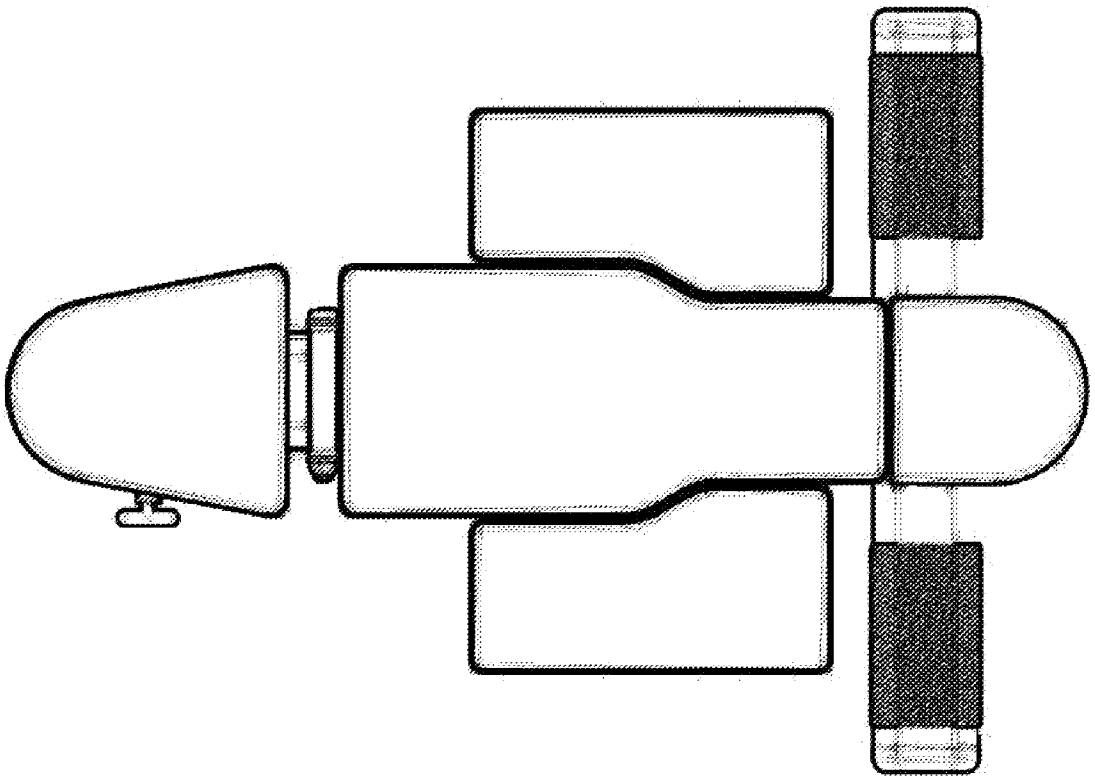
FIG. 4 is a top plan view of the of the exercise bench with pads 100 according to the embodiments of the present disclosure.

FIG. 4 is a top plan view of the of the exercise bench with pads 100 according to the embodiments of the present disclosure.

Figure 5:
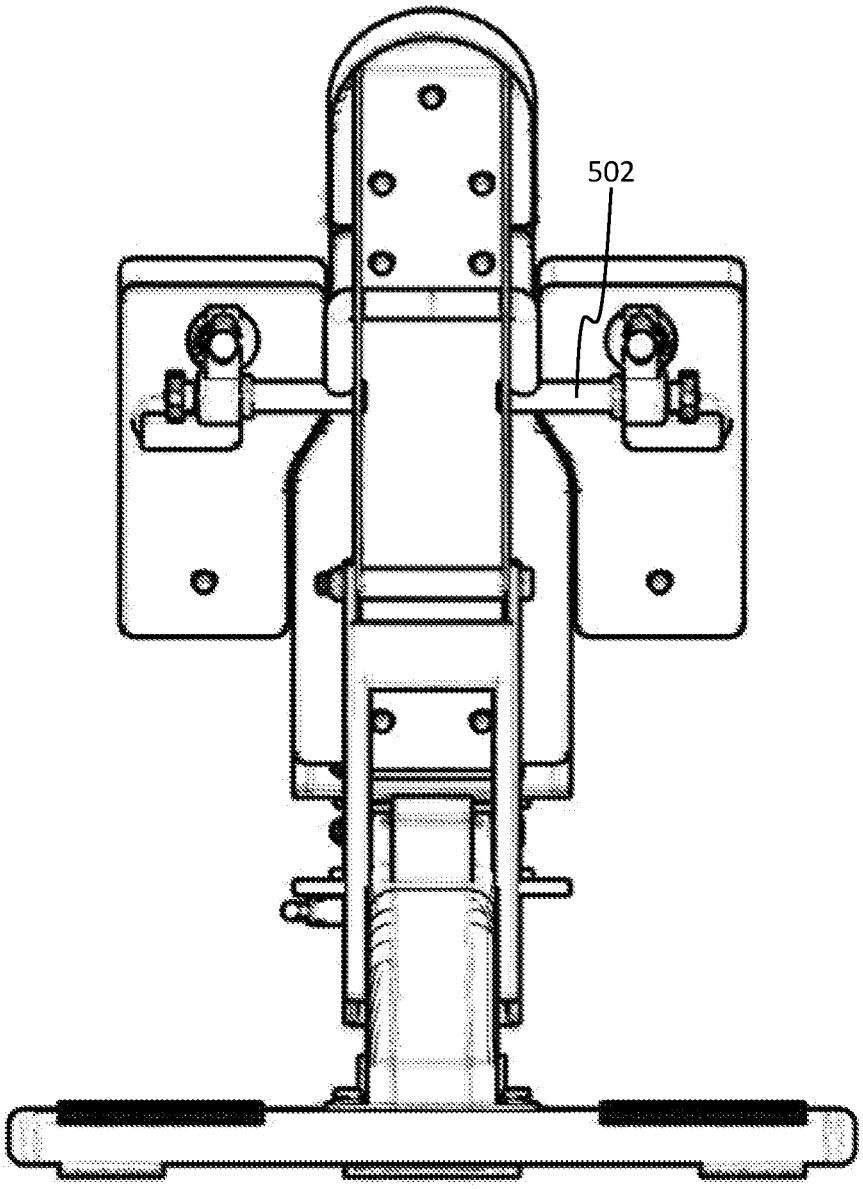
FIG. 5 is a bottom plan view of the of the exercise bench with pads 100 according to the embodiments of the present disclosure.

FIG. 5 is a bottom plan view of the of the exercise bench with pads 100 according to the embodiments of the present disclosure. Solid bar 502 is a robust and rigid component that connects or supports other parts of the exercise bench. Herein, it is associated with the side pad, this bar helps in attaching the side pad to the main frame of the exercise bench, ensuring stability and strength while the user exercises.

Figure 6:
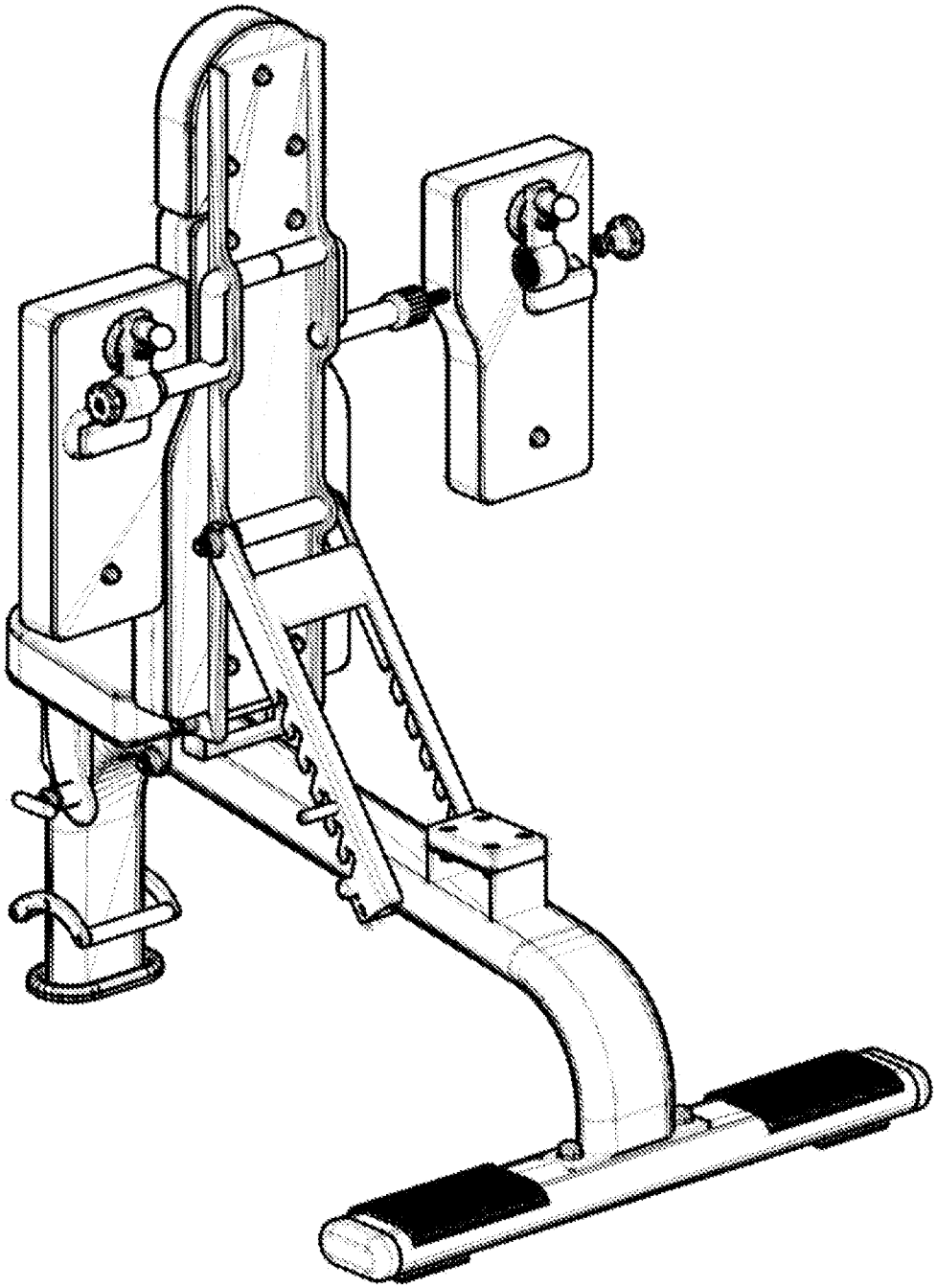
FIG. 6 is a perspective view of the rear side of the exercise bench with pads 100 with one of its side pads removed according to the embodiments of the present disclosure.

FIG. 6 is a perspective view of the rear side of the exercise bench with pads 100 with one of its side pads removed according to the embodiments of the present disclosure. The figure illustrates the connections between the side pads 102 and the solid bar 502. A detailed understanding of the connections between various components is provided in the explanation of FIGS. 7 & 8.

Figure 7:
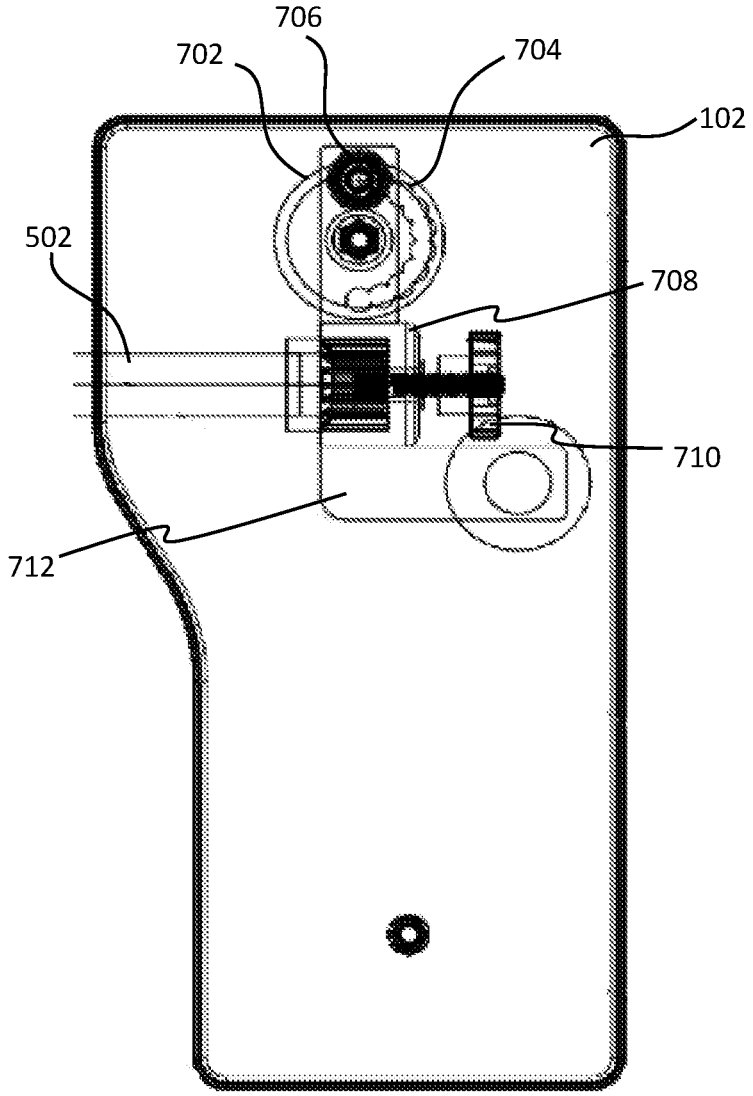
FIG. 7 is a rear view of the side pads of the exercise bench with pads 100 according to the embodiments of the present disclosure.
Figure 8:
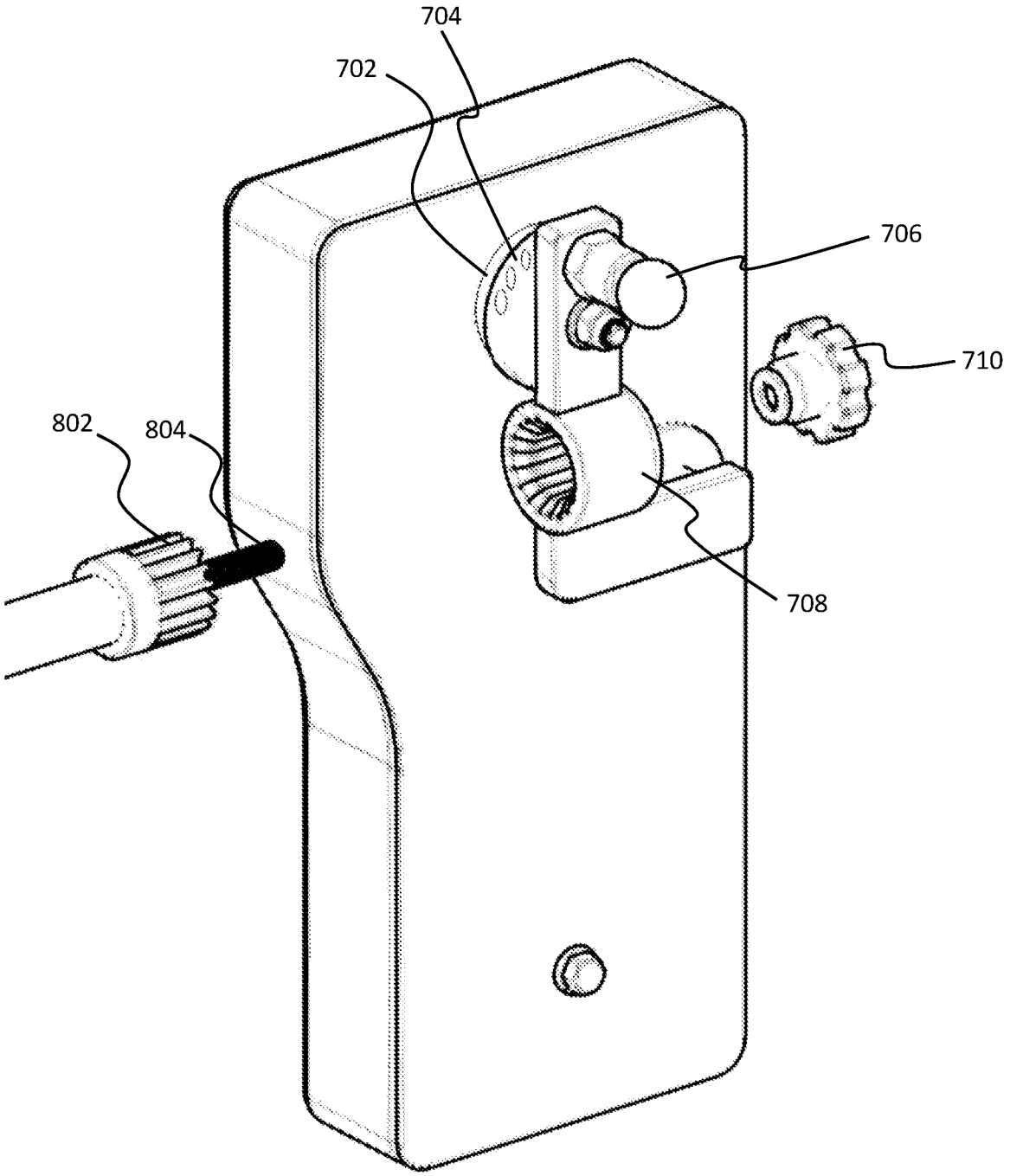
FIG. 8 is a perspective view of the rear side of the side pads of the exercise bench with pads 100 according to the embodiments of the present disclosure.
Figure 9:
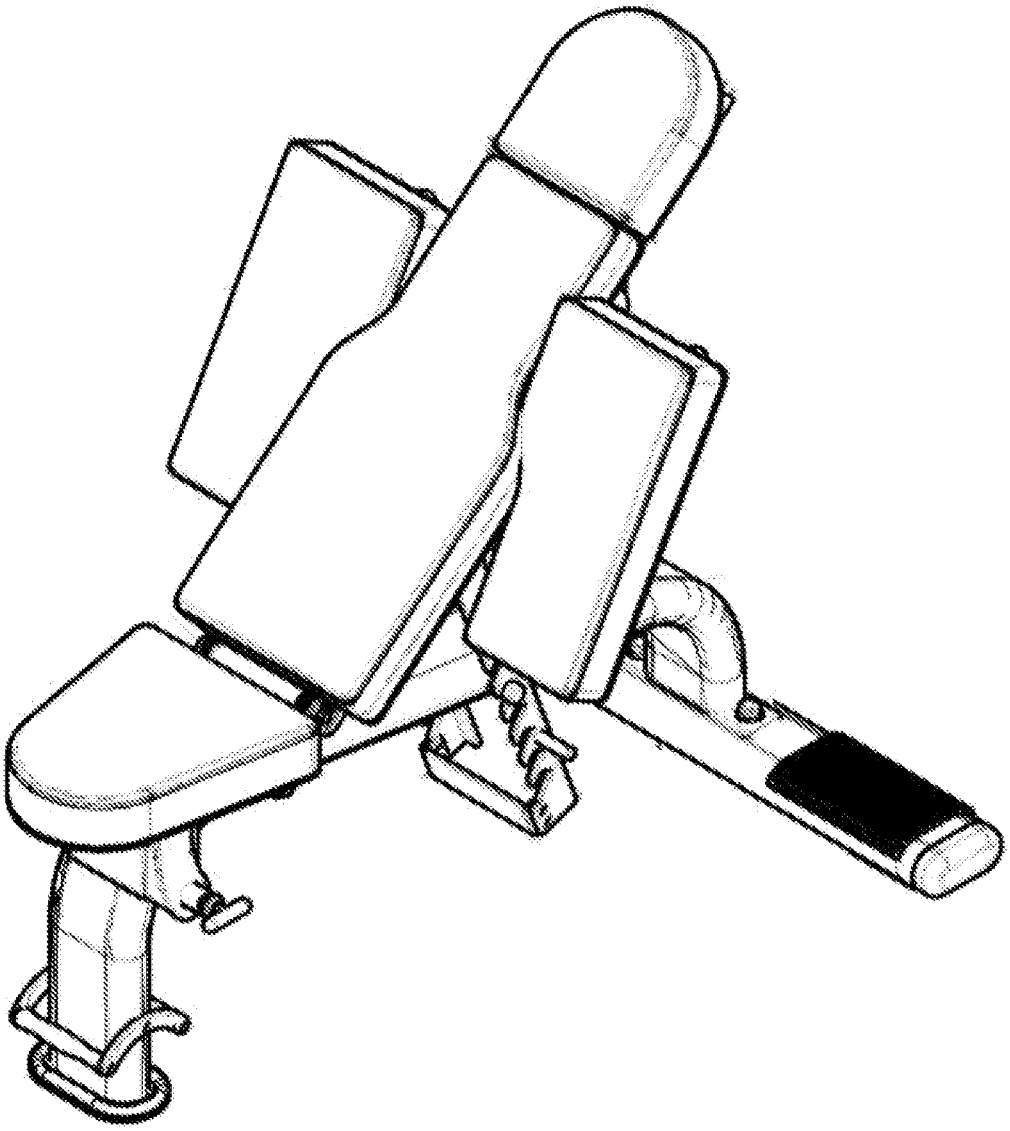
FIG. 9 is a perspective view of the exercise bench with pads 100 with side pads at a 20-degree angle towards the down position according to the embodiments of the present disclosure.
Figure 10:
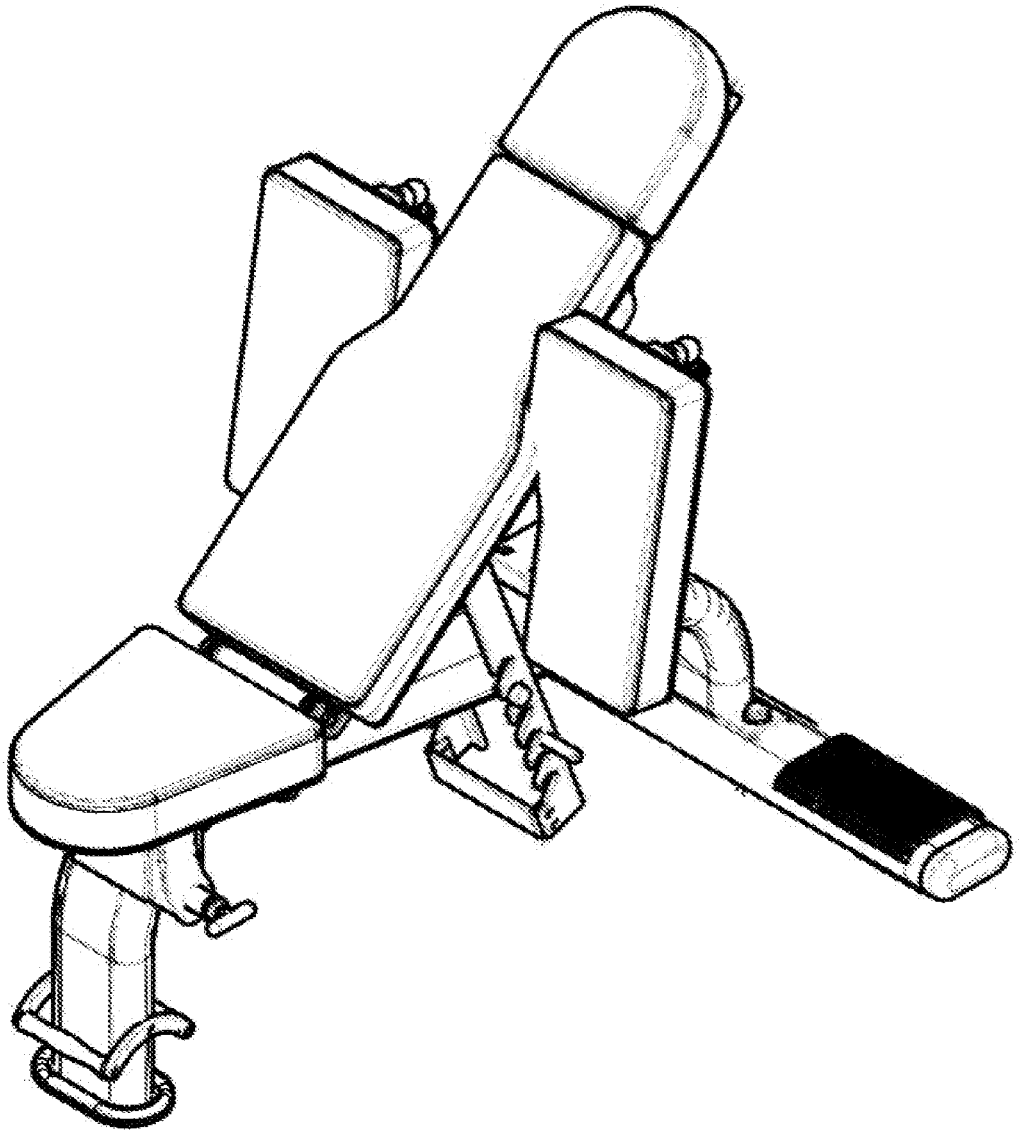
FIG. 10 is a perspective view of the exercise bench with pads 100 with the side pads in the full downward position according to the embodiments of the present disclosure.
Figure 11:
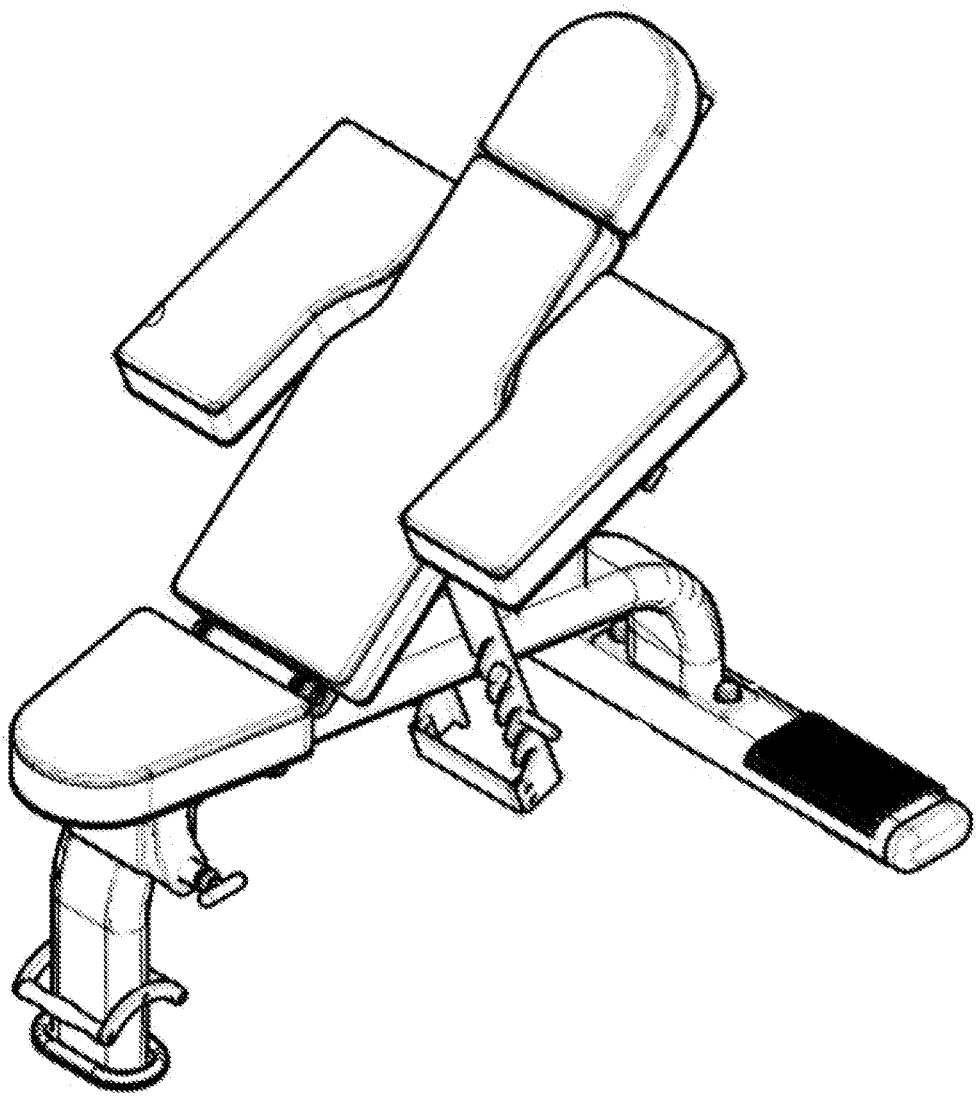
FIG. 11 is a perspective view of the exercise bench with pads 100 with side pads at a 20-degree angle in the upward position according to the embodiments of the present disclosure.
Figure 12:
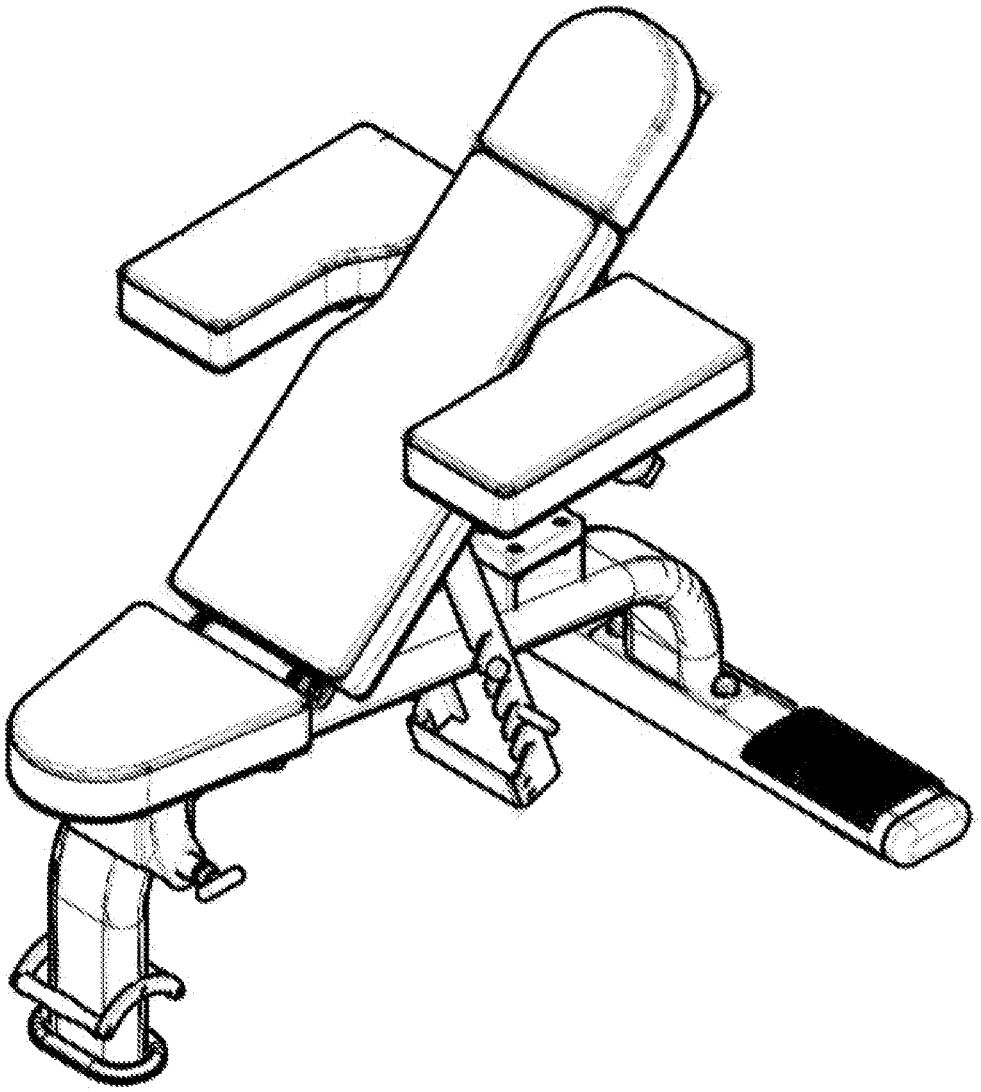
FIG. 12 is a perspective view of the exercise bench with pads 100 with side pads at a 40-degree angle in the upward position according to the embodiments of the present disclosure.
Figure 13:
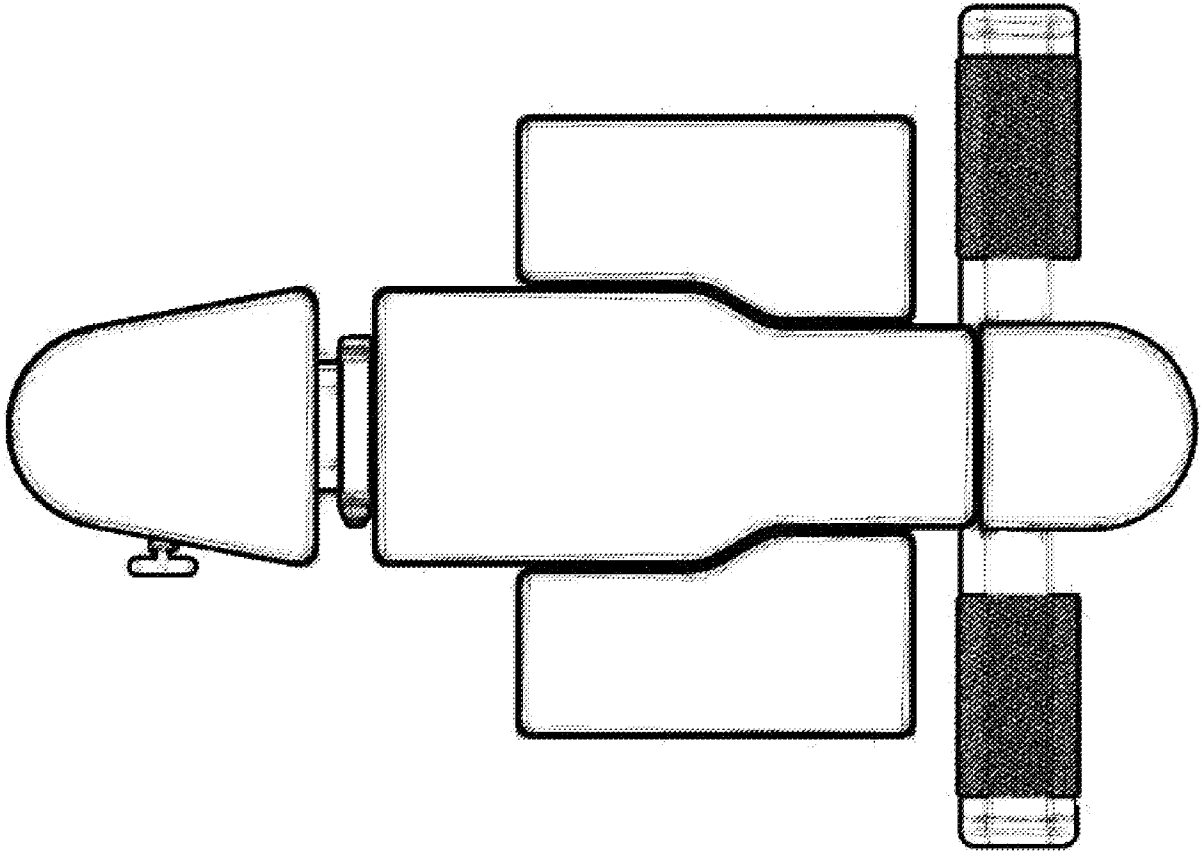
FIG. 13 is a top view of the exercise bench with pads 100 with the side pads in the normal position according to the embodiments of the present disclosure.
Figure 14:
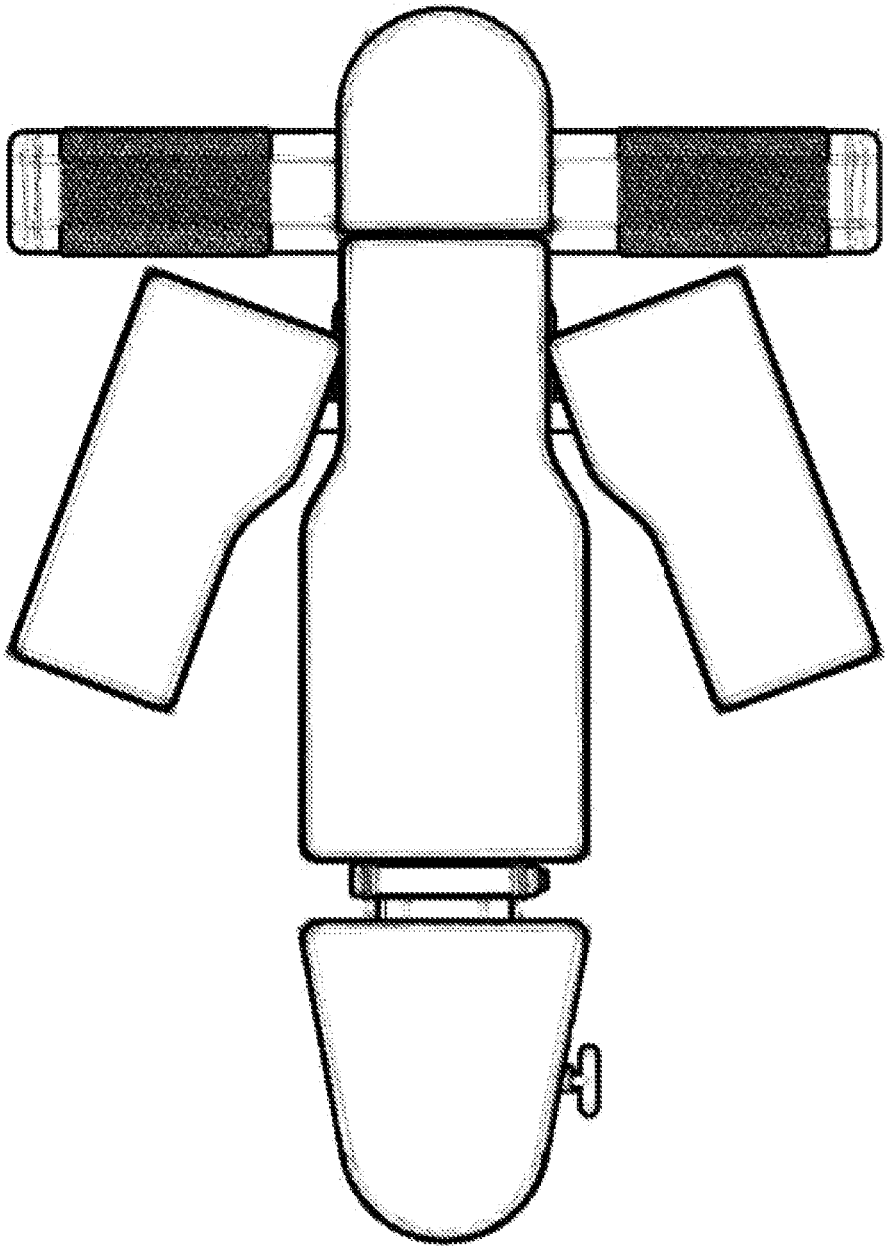
FIG. 14 is a top view with side pads in a 20-degree rotated position according to the embodiments of the present disclosure.
Figure 15:
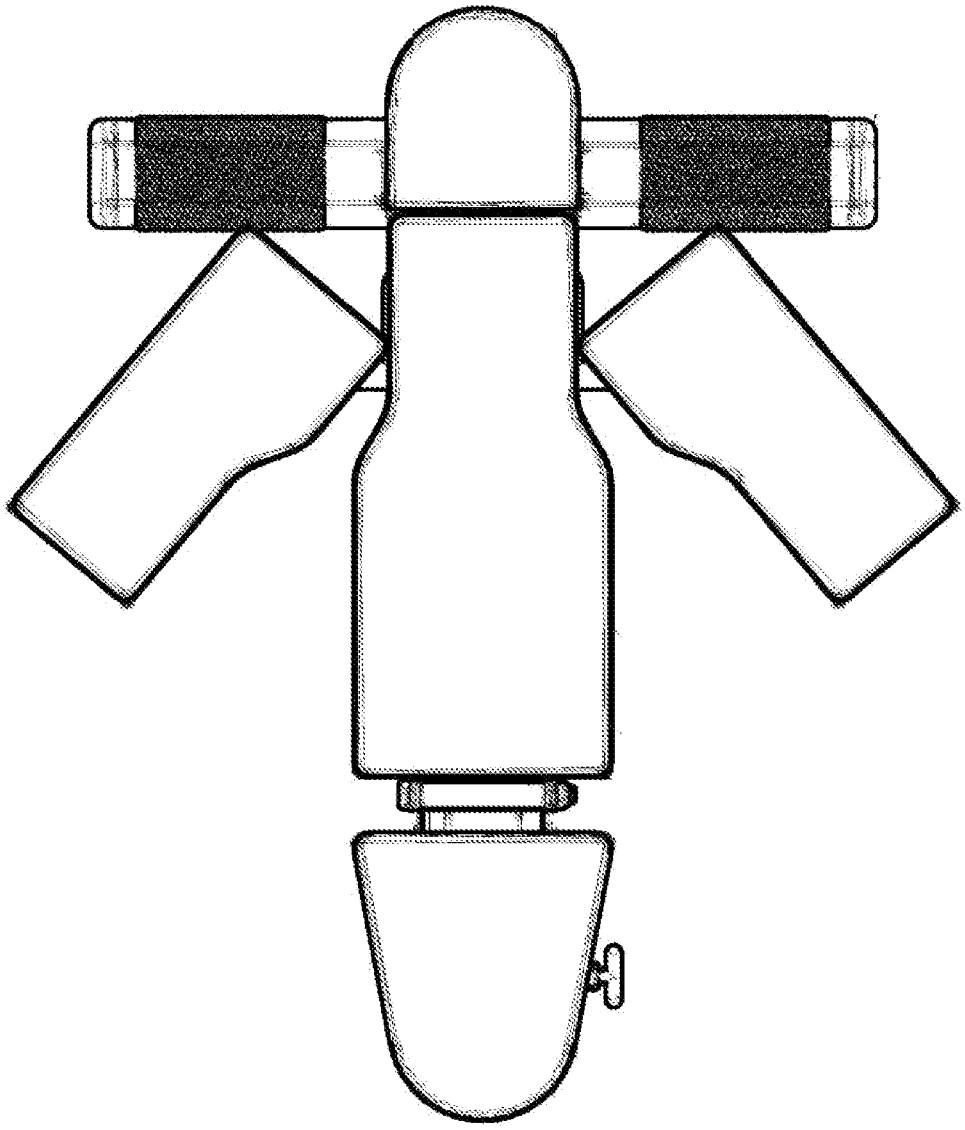
FIG. 15 is a top view with side pads in a 40-degree rotated position according to the embodiments of the present disclosure.
Figure 16:
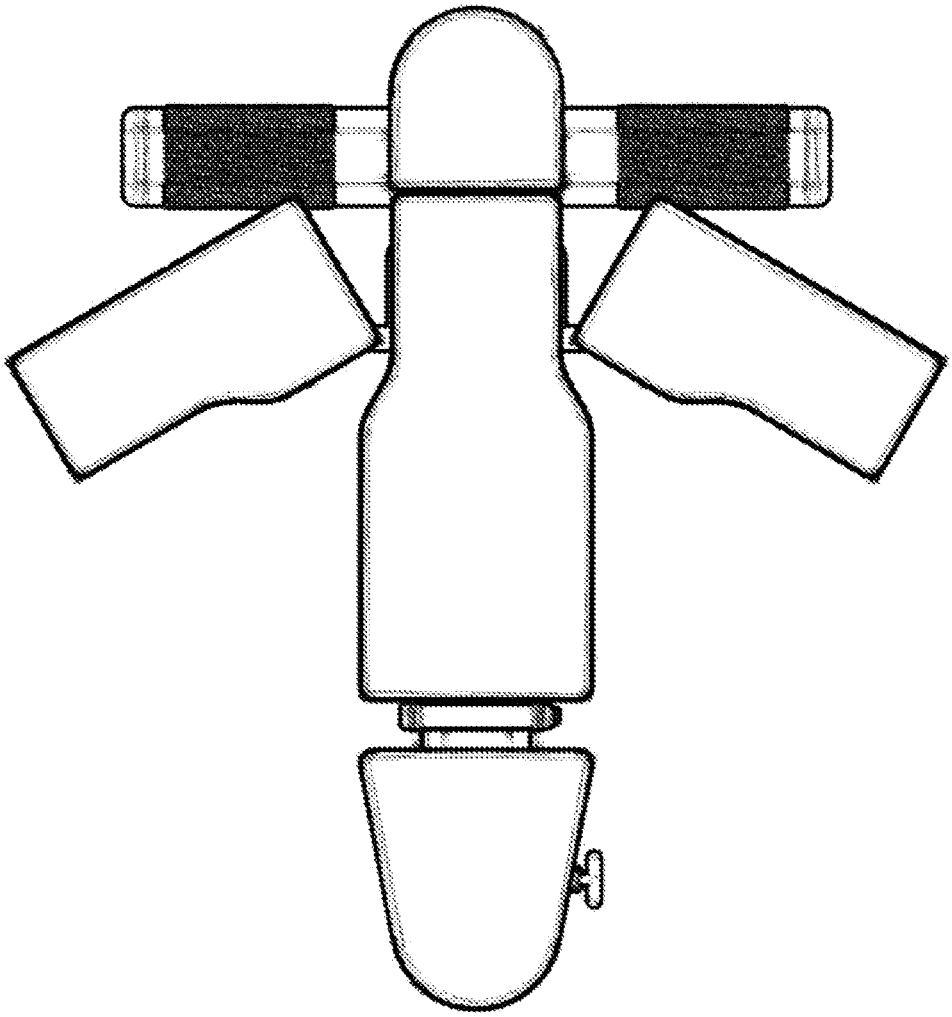
FIG. 16 is a top view with the side pads in an outwardly rotated position according to the embodiments of the present disclosure.

FIG. 7 is a rear view of the side pads of the exercise bench with pads 100 according to the embodiments of the present disclosure. Herein, the solid bar 502 connects to an L-shaped connector 712. The top portion of the L-shaped connector 712 connects to a mounting plate 702 that connects to the side pad 102. A Pad Rotation Plate 704 disposed on the mounting plate 702 is a part of the mechanism that allows the side pad's rotation. It comprises a plurality of holes at every 20 degrees, indicating it's used to set and lock the side pad at different angles. When combined with other components, such as a spring-loaded pin 706, users can choose a desired rotational position and lock the side pad in place for a stable exercise experience. Pad rotation plate 704 is a part of the side pad's rotational mechanism, this plate is used in conjunction with a spring-loaded pin system 706. The pin may engage with holes in the pad rotation plate 704, allowing the side pad to be locked at various angles. The "fixed" nature of the mounting plate 702 and the pad rotation plate 704 implies that while other parts might rotate or adjust, these plates remains stationary, providing a reference or anchor point for those adjustments.

The upward and downward movement of the side pad 102 is facilitated by a splined shaft and housing mechanism. It is a type of gear or shaft that has ridges (splines) on its surface. In the context of the exercise bench, it's part of the mechanism allowing the side pad to rotate upward or downward. A splined shaft 802 (refer FIG. 8) engages with another splined component (like the splined housing 708) to allow adjustments and rotations while maintaining a secure connection. Herein, the solid bar 502 is equipped with a spline shaft (illustrated in FIG. 8—reference number 802) on one end that engages a spline housing 708. Housing is essentially a casing or shell that accommodates the splined shaft 802. When the splined shaft 802 and housing engage, they enable the side pad's upward and downward rotation. The user can adjust the angle by sliding the housing to the required position on the splined shaft. A replacement knob 710 may be screwed to a threaded portion 804 provided at the end of the splined shaft 802. This mechanism secures the position of the side pad during upward/downward movement. The replacement knob 710 may be unscrewed to fix the side pad 102 at any desired angle (upward/downward movement) and then screwed all over again to secure the selected position.

FIGS. 9-12 are perspective views of the exercise bench with pads 100 with side pads at a various angles towards upward and downward positions according to the embodiments of the present disclosure. FIGS. 13-16 are top views of the exercise bench with pads 100 with the side pads in different positions illustrating sideways positioning of the side pads according to the embodiments of the present disclosure.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All the features disclosed in this specification (including any accompanying claims, abstract and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter.

What is claimed is:

1. An exercise bench apparatus, comprising:

a main frame;

a height-adjustable back rest affixed to the main frame, wherein said back rest is capable of adjusting to multiple inclinations;

a pair of side pads, each side pad being adjustably connected to the main frame; and an adjustable mechanism for each side pad, the mechanism comprising:

a solid bar associated with the main frame;

an L-shaped connector coupled to the side pad via a mounting plate;

a splined shaft integrated at one end of the solid bar, the splined shaft being received within a splined housing mounted on the L-shaped connector to allow upward and downward rotation of the side pad;

a pad rotation plate disposed on the mounting plate having a plurality of holes at predetermined angular intervals for facilitating sideways adjustments of the side pad; and a spring-loaded pin system supported on the L-shaped connector and biased to selectively engage the holes of the pad rotation plate, thereby locking the side pad at a plurality of sideways angles relative to the mounting plate.

2. The exercise bench apparatus of claim 1, wherein the main frame further comprises a pivot mount mechanism facilitating the adjustable inclination of the height-adjustable back rest.

3. The exercise bench apparatus of claim 1, further comprising a resting head pad affixed to the main frame.

4. The exercise bench apparatus of claim 3, wherein the resting head pad is positioned in alignment with the height-adjustable back rest.

5. The exercise bench apparatus of claim 1, further comprising a sitting pad attached to the main frame.

6. The exercise bench apparatus of claim 5, wherein the sitting pad is pivotally attached to the main frame, allowing for adjustable angling to accommodate various exercise postures.

7. The exercise bench apparatus of claim 1, further comprising a handle affixed to the main frame, wherein the handle facilitates the movement or repositioning of the entire bench.

8. The exercise bench apparatus of claim 1, further comprising a footing mechanism attached to the main frame, configured to stabilize the bench on a surface.

9. The exercise bench apparatus of claim 8, wherein the footing mechanism includes non-slip materials or components to prevent unwanted movement of the bench during exercise activities.

10. The exercise bench apparatus of claim 8, wherein the footing mechanism comprises a plurality of feet, each foot designed to distribute weight evenly and minimize floor damage.

11. The apparatus of claim 8, wherein the footing mechanism comprises of a three-footed base, each foot equipped with a rubber pad.

* * * * *